US006076514A

United States Patent [19]

Adams, Jr.

[11] Patent Number: 6,076,514

[45] Date of Patent: Jun. 20, 2000

[54] ARCHERY BOW STABILIZER

[76] Inventor: Charles C. Adams, Jr., P.O. Box 30480, Jackson, Wyo. 83001

[21] Appl. No.: 09/232,569

[22] Filed: Jan. 16, 1999

[51] Int. Cl.[7] ..... F41B 5/20

[52] U.S. Cl. ..... 124/89

[58] Field of Search ..... 124/89; 267/136, 267/137, 140.12, 141.2

[56] References Cited

U.S. PATENT DOCUMENTS

| | | | |
|---|---|---|---|
| 3,524,441 | 8/1970 | Jeffery | 124/89 |
| 3,670,712 | 6/1972 | Izuta | 124/89 |
| 4,245,612 | 1/1981 | Finlay | 124/89 |
| 4,615,327 | 10/1986 | Saunders | 124/89 |
| 4,986,018 | 1/1991 | McDonald | 124/89 X |
| 5,273,022 | 12/1993 | Leven | 124/89 |
| 5,595,168 | 1/1997 | Martin | 124/89 |

FOREIGN PATENT DOCUMENTS

| | | | |
|---|---|---|---|
| 2575817 | 7/1986 | France | 124/89 |
| 1497441 | 7/1989 | U.S.S.R. | 124/89 |

*Primary Examiner*—John A. Ricci
*Attorney, Agent, or Firm*—Mallinckrodt & Mallinckrodt

[57] ABSTRACT

An archery bow stabilizer is made up of a plurality of blocks of a solid resilient material such as a rubber material joined together in end-to-end relationship. Threaded sleeves in each end of each block allow the blocks to be joined together and the joined together blocks to be secured to the handle riser of a bow in normal manner using threaded studs. Usually three to four joined blocks will provide satisfactory stabilization for most bows but more or less blocks may be used when desired. The invention also contemplates stabilizers with rubber or similar resilient material exterior surfaces to eliminate most noise created by the stabilizer during knock-around in the field.

16 Claims, 2 Drawing Sheets

ARCHERY BOW STABILIZER

BACKGROUND OF THE INVENTION

1. Field

The invention is in the field of stabilizers for archery bows.

2. State of the Art

Stabilizers are often secured to an archery bow handle riser, usually extending from the front thereof, to help balance the bow, counteract torque during shooting of the bow, and to absorb shock and vibration upon shooting of the bow. Stabilizers of which the inventor is aware all have elongate rigid housings, although some have resilient mountings between rigid stabilizer sections or resilient mountings to the bow handle riser.

U.S. Pat. No. 4,615,327 shows a stabilizer having two separate hollow stabilizer housings resiliently joined together to absorb vibration and energy from the bow. The resilient connecting mountings extend into the housing chambers and resilient material separates the two housings.

U.S. Pat. No. 4,245,612 shows a stabilizer having a flexible coupling mounting the stabilizer elongate hollow body to the bow.

While many of the prior art stabilizers work satisfactorily, there is always an attempt to improve stabilizers to make them more effective and versatile. Metal stabilizer housings tend to be somewhat noisy in the field and can rattle and vibrate when knocked around.

SUMMARY OF THE INVENTION

According to the invention, a stabilizer for archery bows includes a plurality of blocks of a solid resilient material such as rubber secured together in end to end manner with one end adapted to be secured to an archery bow handle riser and extend therefrom in normal manner. In a preferred embodiment of the invention, each end of each block has an internally threaded metal sleeve secured therein. An externally threaded stud is threaded into one of the sleeves to extend from the sleeve and end of the block to be screwed into an end of an adjacent block or into the normal stabilizer mounting threads provided in the handle riser of most archery bows.

Satisfactory results are generally obtained when three or four blocks of substantially cylindrical shape of a solid rubber material having between about forty to about ninety durometer hardness are secured together to form the stabilizer although in some instances two blocks work satisfactorily and in other instances an archer may use more than four blocks. By making the stabilizer in a plurality of blocks, the archer is given the flexibility of creating the stabilizer that works best for his or her particular bow and shooting style by using as many or as few of the blocks as the archer desires.

By using rubber blocks, the entire exterior surface of the stabilizer is rubber which eliminates most noise that results from hitting a metal stabilizer during knock-around in the field. Thus, the invention also contemplates coating a conventional metal stabilizer with rubber or similar resilient material so that the exterior surface of the stabilizer is rubber or other similar resilient material.

THE DRAWINGS

The best mode presently contemplated for carrying out the invention is illustrated in the accompanying drawings, in which:

FIG. 1 is a side elevation of an archery bow with the stabilizer of the invention attached thereto;

FIG. 2, an enlarged, fragmentary side elevation with portions thereof broken away of the stabilizer of the invention and the mounting portion of the handle riser of the bow of FIG. 1;

FIG. 3, an end elevation of the stabilizer of FIGS. 1 and 2; and

FIG. 4, a vertical section taken on the line 4—4 of FIG. 3, showing a single stabilizer section.

DETAILED DESCRIPTION OF THE ILLUSTRATED EMBODIMENT

Figures 1, 2:
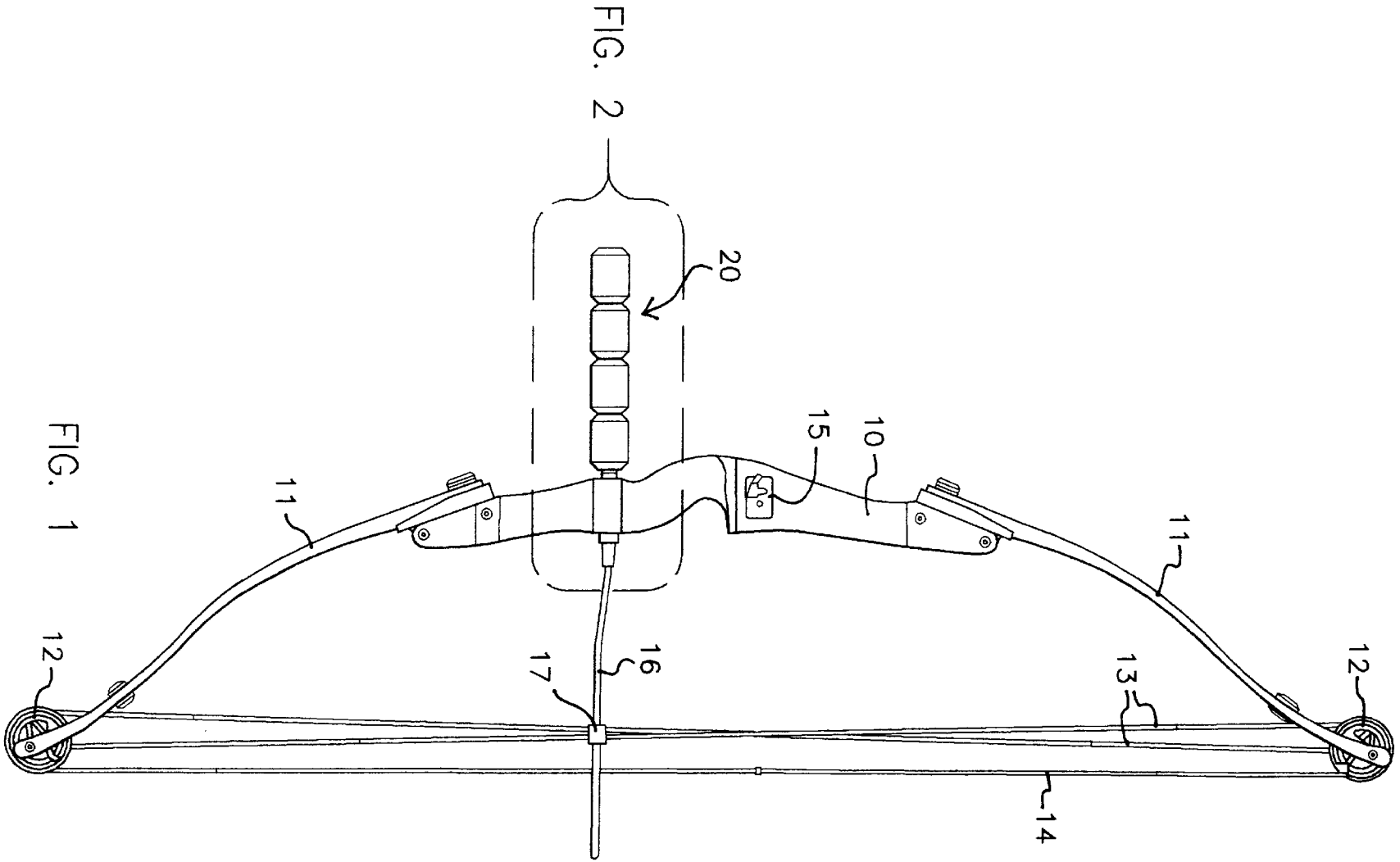
Figure 2:
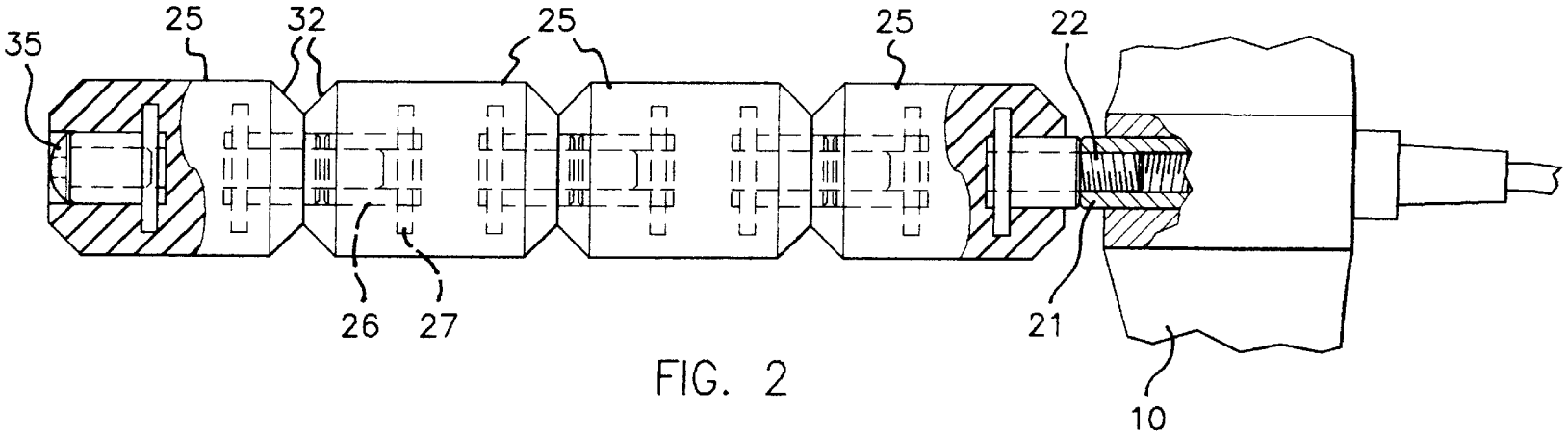

A typical compound archery bow is shown in FIG. 1. The bow includes a handle riser 10 with limbs 11 extending from the ends thereof. Wheels 12 are eccentrically mounted at the outer ends of limbs 11 with cables 13 and bowstring 14 extending between the wheels. An arrow rest 15 is mounted in normal position on handle riser 10 and a cable guard 16 extends from attachment to riser 10 with a cable retaining member 17 slidably mounted thereon. This is typical of a compound bow and is used herein merely for illustrative purposes as the invention applies to any type of archery bow.

Most handle risers 10 of currently available archery bows provide for the removable mounting of a stabilizer, shown generally as 20, to the riser in the general area of the riser as shown in FIG. 1, so that the stabilizer 20 extends forwardly of the bow (in a direction away from the archer holding the bow). In the bow shown, an internally threaded insert 21, FIG. 2, is securely positioned in riser 10 in any known manner so that a stabilizer may be secured to the riser by a threaded stud 22 which extends from the stabilizer and is screwed into insert 21.

The stabilizer of the invention is made up of a plurality of blocks 25 of a solid resilient material such as rubber. Each block 25 includes means for connecting the block to another adjacent block or to an archery bow handle riser. These means may take various forms with an internally threaded sleeve 26 embedded in the ends of the blocks being a particularly convenient means. The sleeves may be metal sleeves and in such instance, such sleeves at each end of the block are separated by the resilient shock and vibration absorbing material. The weight of the sleeves are considered in planning the total weight of the blocks. Also, each sleeve should have a flange 27 or other means for holding the sleeve in the block when embedded therein. Holes provided through the flange through which the rubber material can extend will help secure and hold the sleeves against rotation.

Figure 4:
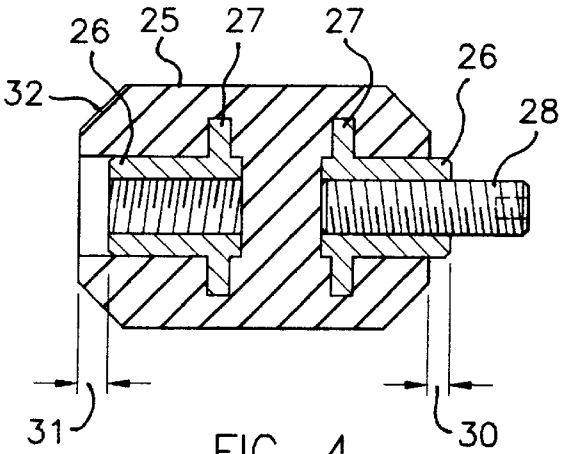
Figure 3:
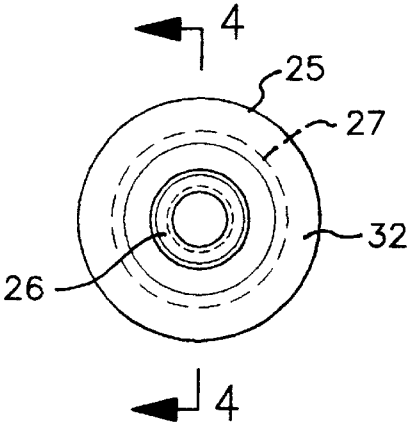

An externally threaded stud 28 is threaded into one of the sleeves of each block 25 so that an end thereof extends from the sleeve and can be screwed into a sleeve of another block 25 to join the blocks in end-to-end relationship as shown in FIGS. 1 and 2. The stud 28 extending from the end block of the stabilizer assembly forms stud 22 of the stabilizer to be screwed into the threaded insert 21, FIG. 2, of the bow handle riser. The studs generally will be standard 5/16-inch threaded studs which screw into the standard threaded insert 21. A material such as Lock-Tite may be applied to the threads on one side of the stud or Nylok or other means may be used in one of the sleeves to hold the stud against rotation in that sleeve while it is being screwed into or screwed out of an adjoining sleeve or into or out of the bow handle riser. Sleeves 26 may be positioned in each of the blocks so that the sleeve 26 at one end extends a short distance 30, FIG. 4, beyond the end of the block while the sleeve 26 at the other end is inset a similar or slightly greater distance 31. This allows the extending sleeve of one block to extend into and interlock with the adjacent block when the blocks are joined, as indicated in FIG. 2.

Alternate constructions allow a bolt to be embedded into the block with the end thereof extending from the block to form the threaded stud, or for plates with threaded holes therethrough to be embedded in the blocks in place of the sleeves with the threaded holes receiving the studs in the same manner as the sleeves.

The blocks are preferably substantially cylindrical which provides about the same flexibility in all radial directions in the block and has tapered end portions 32. The tapered end portions provide more flexibility between the blocks at the joints to provide better vibration and shock-absorption.

By solid resilient material for the blocks is meant a material which generally maintains its shape and supports itself with several blocks thereof joined together and cantilevered at one end from the bow riser, but is sufficiently flexible or resilient to absorb vibration and shock. Blocks of a substantially solid rubber material have been found satisfactory with the currently preferred hardness of the material being between about forty and about ninety durometer. With a rubber material, below about forty durometer, the stabilizer will droop and above about ninety durometer, the material becomes too solid and loses its ability to absorb vibration and shock satisfactorily. The usable range of hardness will vary with the particular materials used. With rubber material, the presently preferred hardness is between about sixty and about eighty durometer. A weight for each block of about two and one-half ounces has been found satisfactory and for substantially cylindrical blocks with tapered ends as shown, a block of diameter of about 1.375 inches and length of about two inches with embedded metal threaded sleeves has been found satisfactory to provide the desired weight and vibration and shock absorption. The extension distance 30 may be about 0.125 inch while the inset distance 31 may be a little larger at about 0.168 inch to allow for compression of the rubber when the blocks are joined. Such compression will tend to hold the blocks against coming apart during normal use of the bow and stabilizer.

While the drawings show the solid resilient material extending fully between the embedded sleeves, a hollow bore or other configuration could extend between the sleeves. In one aspect of the invention, the important consideration is that any rigid sleeves or other rigid connecting means embedded in the block not be rigidly connected. This eliminates a rigid stabilizer extending from the bow. Any rigid connections between the blocks (e.g. metal sleeves and metal connecting stud) should be isolated by the solid resilient material so that shock and vibration can be absorbed by that material between connections.

While a special outer end block having only one sleeve could be made for the outer end block of the stabilizer, or a sleeve could be left open at the outer end of the stabilizer when a block 25 with sleeves at both ends is used for the outer end block, use of such sleeve being preferred, an end button head cap screw 35, FIG. 2, may be screwed into the sleeve at the end of the completed stabilizer to give the stabilizer a finished appearance and to protect and keep debris out of the sleeve. Other hole closing or cover means could be used.

Normally the use of three or four blocks joined together in end-to-end manner will be satisfactory as a stabilizer for most bows, four blocks being shown in FIGS. 1 and 2. However, more blocks can be used or only two blocks can be used. Generally, a single block will not provide the desired stabilization of the bow, although a single block can be added to a prior art stabilizer to increase its stabilization properties.

It has been found that, unlike metal stabilizers, the stabilizer of the invention is much quieter on its surface during knock-around use in the field. It substantially reduces game-spooking bumps and rattles. Further, some testing indicates that the stabilizer of the invention reduces bow torque and vibration to the extent that arrow speeds increase two to three feet per second over the same bows without stabilizers. This result was better than with other commercial stabilizers tested.

With the stabilizer of the invention being made up of a plurality of identical blocks or sections, the archer has increased flexibility to create a stabilizer suited to his or her needs by adding or subtracting blocks as desired.

As indicated above, it has been found that the stabilizer of the invention is much quieter on its surface during knock-around use in the field. This is because the entire outer surface of the stabilizer is rubber or similar resilient material. By knock-around use is meant that when bows are carried and handled in the field, the stabilizer can hit various objects which cause a metal stabilizer to make a noise. Thus, the invention also contemplates any stabilizer having its outer surface substantially all rubber or other resilient material to eliminate most noise during knock-around in the field. Thus, a conventional metal stabilizer could be coated with a rubber or other resilient material to achieve this result. This would give one of the benefits of the invention although the full advantage of the improved shock and vibration absorption of the invention during shooting may not be present.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A stabilizer for an archery bow, comprising:

a plurality of blocks of resilient material;

means for connecting the blocks of resilient material together in end-to-end manner; and means for mounting the end of one of the plurality of blocks to an archery bow riser.

2. A stabilizer according to claim 1, wherein the means for connecting the blocks of resilient material together in end-to-end manner includes an internally threaded sleeve secured in each end of at least each of the plurality of blocks but one to receive an externally threaded stud therein extending into and between adjacent blocks, and an externally threaded stud securing each of the blocks together in end-to-end manner and for securing the end of one of the blocks to an archery bow handle riser.

3. A stabilizer according to claim 2, wherein the sleeves are secured in each end of each block.

4. A stabilizer according to claim 3, wherein the sleeves are embedded in the ends of the blocks.

5. A stabilizer according to claim 4, wherein each sleeve includes means embedded with the sleeve in the block to more securely hold the sleeve in the block.

6. A stabilizer according to claim 3, wherein the plurality of blocks when secured together and secured to a bow handle riser have an end of a block forming the end of the stabilizer away from the handle riser having a sleeve therein, including a cap screw in the sleeve end of the stabilizer.

7. A stabilizer according to claim 3, wherein one of the sleeves in a block extends from the end of the sleeve and the other sleeve is inset in the block to form an inset so that when blocks are secured together, the extending sleeve of one block extends into the inset of an adjoining block.

8. A stabilizer according to claim 2, wherein the blocks are formed of a rubber material.

9. A stabilizer according to claim 8, wherein the rubber material has a durometer of between about forty and about eighty.

10. A stabilizer according to claim 9, wherein the sleeves are embedded in the ends of the blocks.

11. A stabilizer according to claim 10, wherein each sleeve includes holding means embedded with the sleeve in the block to more securely hold the sleeve in the block.

12. A stabilizer according to claim 8, wherein the blocks are of substantially cylindrical shape.

13. A stabilizer according to claim 1, wherein the blocks are of substantially cylindrical shape.

14. A stabilizer according to claim 1, wherein the blocks are formed of a rubber material.

15. A stabilizer according to claim 14, wherein the rubber material has a durometer of between about forty and about ninety.

16. A method for reducing noise during knock-around use of a stabilizer for an archery bow having a metal exterior surface, comprising the step of:

coating substantially the entire exterior surface of the stabilizer that may be hit during knock-around use of a bow to which the stabilizer may be mounted with a resilient material.

* * * * *